US005560524A

United States Patent [19]

Brune

[11] Patent Number: 5,560,524

[45] Date of Patent: Oct. 1, 1996

[54] COMBINATION GEAR PACK AND PIVOTABLE SEAT MEMBER

[76] Inventor: Paul W. Brune, Rte. 1 Box 185K, New Haven, Mo. 63068

[21] Appl. No.: 358,260

[22] Filed: Dec. 19, 1994

[51] Int. Cl.[6] ..... A45F 4/02

[52] U.S. Cl. ..... 224/155; 224/153; 224/627

[58] Field of Search ..... 224/151, 155, 224/156, 209, 627, 153

[56] References Cited

U.S. PATENT DOCUMENTS

| | | | |
|---|---|---|---|
| 3,307,758 | 3/1967 | Platt | 224/155 |
| 4,676,548 | 6/1987 | Bradbury | 224/155 |
| 5,031,811 | 7/1991 | Charest | 224/155 |
| 5,275,315 | 1/1994 | Carmack et al. | 224/151 |

*Primary Examiner*—David J. Walczak
*Attorney, Agent, or Firm*—Robbins & Robbins

[57] ABSTRACT

A combination gear pack and pivotable seat member is provided. The seat member is connected at the bottom of the gear pack and is pivotable between positions over a range in respect to the front and the rear of the pack. Straps support the seat member from the pack to create an effective chair, and the straps are adjustable so that the angular orientation of the seat member with respect to the pack can be adjusted for comfort to the user. The pack and the seat member are reinforced with rigid edges for seating comfort and structural support. The seat member, when not in use as a chair, can also be swung back to compressively secure a load against the pack.

20 Claims, 6 Drawing Sheets

COMBINATION GEAR PACK AND PIVOTABLE SEAT MEMBER

BACKGROUND OF THE INVENTION

In today's active society, convenience and utility are critical factors in one's pursuit of recreation. With more and more activities leading one out of the home and towards the great outdoors, the ability to take along items of recreation is limited. When hiking for instance, it is impractical to carry along more than a minimum amount of supplies. A chair would be desirable to take, but it gets burdensome to carry and is difficult to pack. A backpack or fanny pack is normally carried but space limitations dictate what can be stored in them. Smaller items such as food and extra clothing generally take precedence. Therefore, seating comfort is often sacrificed.

Sporting and concert events provide great entertainment, but the experience can be dampened if one's seat is uncomfortable, dirty or wet. Many times, there is no backed chair provided, and one has to sit on a flat bleacher or even on the ground. People might bring lawn chairs and the like, but these may be cumbersome to carry and may not even fit into the seat space provided. Some small collapsible chairs are good for this purpose, but they can be a nuisance to carry, especially with an armload of refreshments.

It would therefore be desirable to have a comfortable collapsible chair that can be easily transported in similar fashion to a backpack.

SUMMARY OF THE INVENTION

By means of the instant invention there is provided a combination gear pack and seat member. The gear pack is a standard backpack or "fanny" pack comprising a fabric bag member for storing articles. A seat member is connected along the bottom edge of the bag member which enables it to pivot to positions on either side of the pack.

Straps are provided to support the seat member from the pack. The seat member can be pivoted forward to a front face of the pack and supported by the straps to form an effective seat which can be placed either directly on the ground or bleacher, or used as a supplement to an existing seat. Padding can be provided for user comfort.

The angular orientation of the seat in relation to the pack can be varied by adjusting the length of the support straps. The longitudinal margin edges of the seat member and the bag member have rigid internal frames to give supportive strength to the seat.

The seat is easily broken down for use as a gear pack by simply releasing the straps and swinging the seat member back upon the other side of the pack. Articles, such as ponchos, bedrolls or the like, can be placed and carried between the seat member and the pack. The straps are re-connected and tightened to draw the seat member against the pack to compress the load.

It is therefore an object of this invention to provide a gear pack having a seat member which can enable the pack to be utilized as an effective backed chair.

It is further an object of this invention to provide a pivotable seat member which can function both as a seat in one position, and can swing back against the pack to help support and compress an external load on the pack.

The above features are objects of this invention. Further objects will appear in the detailed description which follows and will be otherwise apparent to those skilled in the art.

For purpose of illustration of this invention a preferred embodiment is shown and described hereinbelow in the accompanying drawing. It is to be understood that this is for the purpose of example only and that the invention is not limited thereto.

IN THE DRAWINGS

DESCRIPTION OF THE INVENTION

Figure 1:
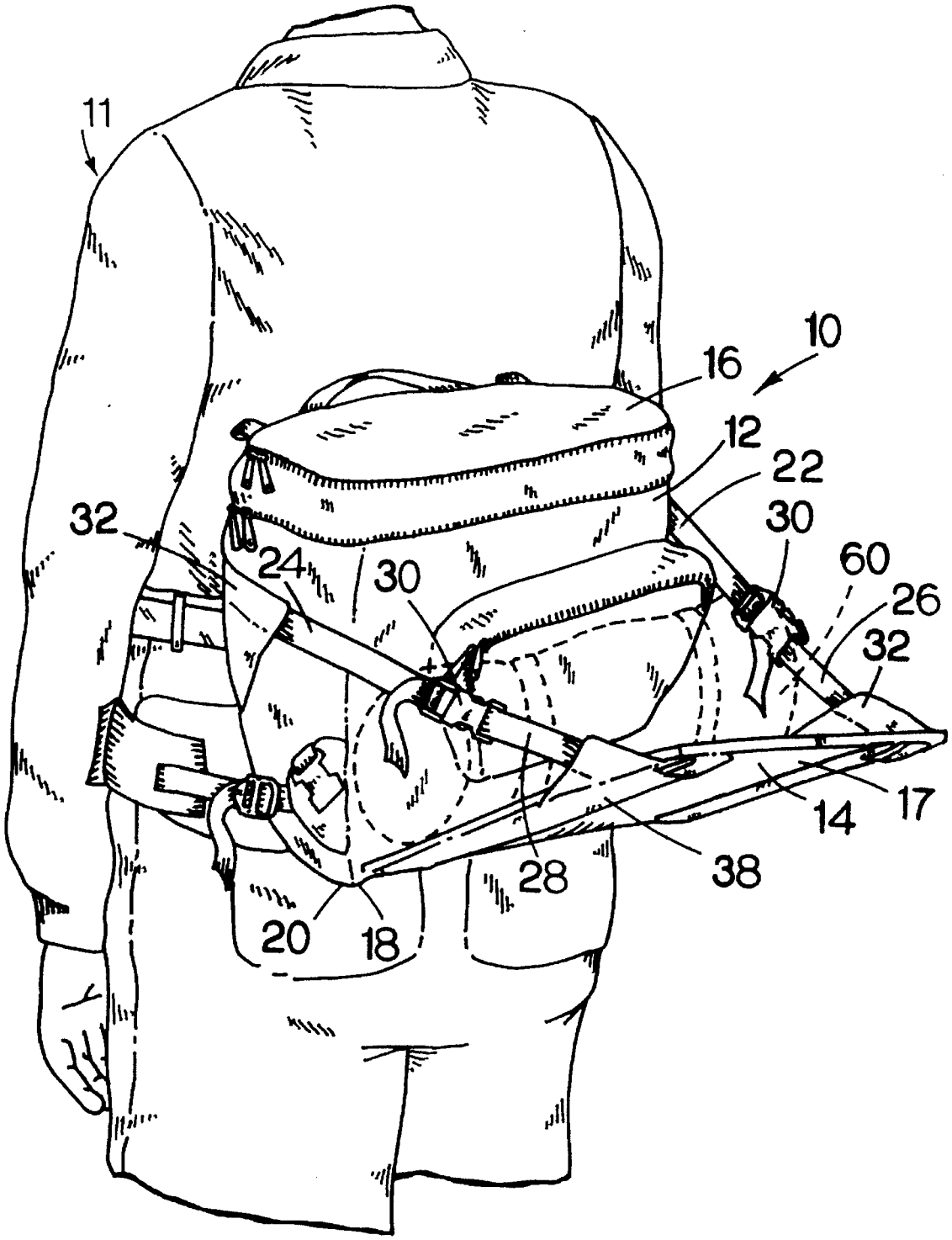
FIG. 1 is a perspective view showing the gear pack being worn by a user, with the seat member pivoted back against the pack to support an external load.

The combination gear pack with pivotable seat member is generally indicated by the reference numeral 10 as shown in FIG. 1. It is comprised of a gear pack 12 and seat member 14. Gear pack 12 comprises a bag member 16 which is typical of such packs and can be a standard backpack, or "fanny" pack. These types of packs can be directly supported on one's back without the use of an external frame and are well known in the art.

Figure 2:
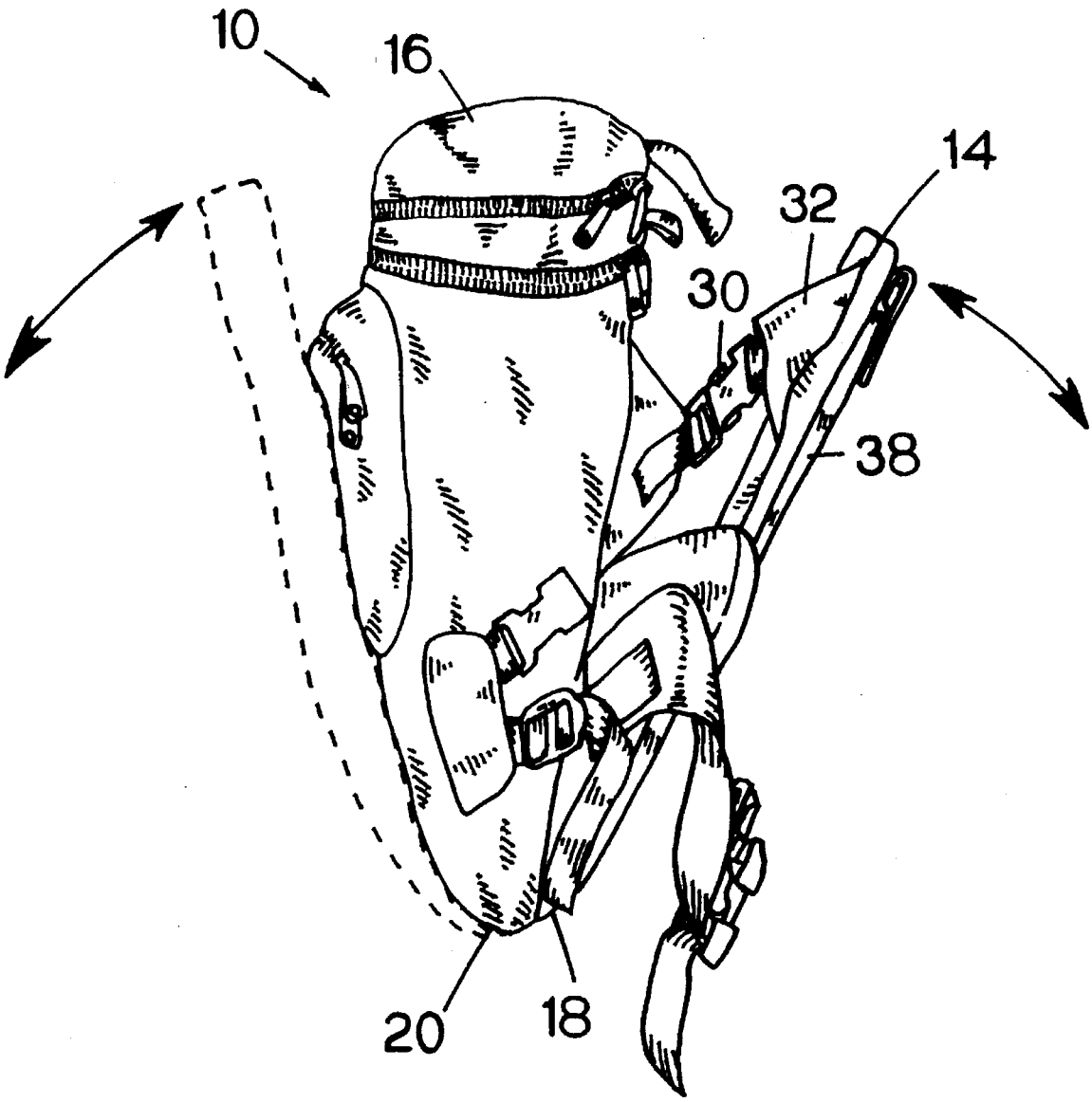
FIG. 2 is a view in side elevation from the side of the pack showing the range of pivot motion of the seat member in relation to the front and back of the pack.

Seat member 14 is comprised of a generally rectangular fabric web 17 of canvas or other suitable material. It is connected along an edge 18 to the bottom edge 20 of bag member 16 as shown in FIGS. 1 and 2. For strength, the connection is made by sewing and stitching. This type of connection allows for pivotable movement of seat member 14 over a range from positions at the relative front side to the relative back side of gear pack 12 as shown in FIG. 2.

Support straps 22 and 24 are affixed to gear pack 12 and connect with straps 26 and 28 which are affixed to seat member 14. Quick connect/disconnect buckles 30 are used for easy connection and release. These buckles also allow straps 22 and 24 to be easily lengthened or drawn shorter so that the angular distance between seat member 14 and gear pack 12 can be adjusted. The respective straps of gear pack 12 and seat member 14 can each be affixed at their base to fabric flaps 32 as shown in FIG. 1. These flaps are flexible and pivotable, and allow the straps to also pivot and reverse direction when seat member 14 is pivoted to a position on the opposite face of gear pack 12.

Figure 4:
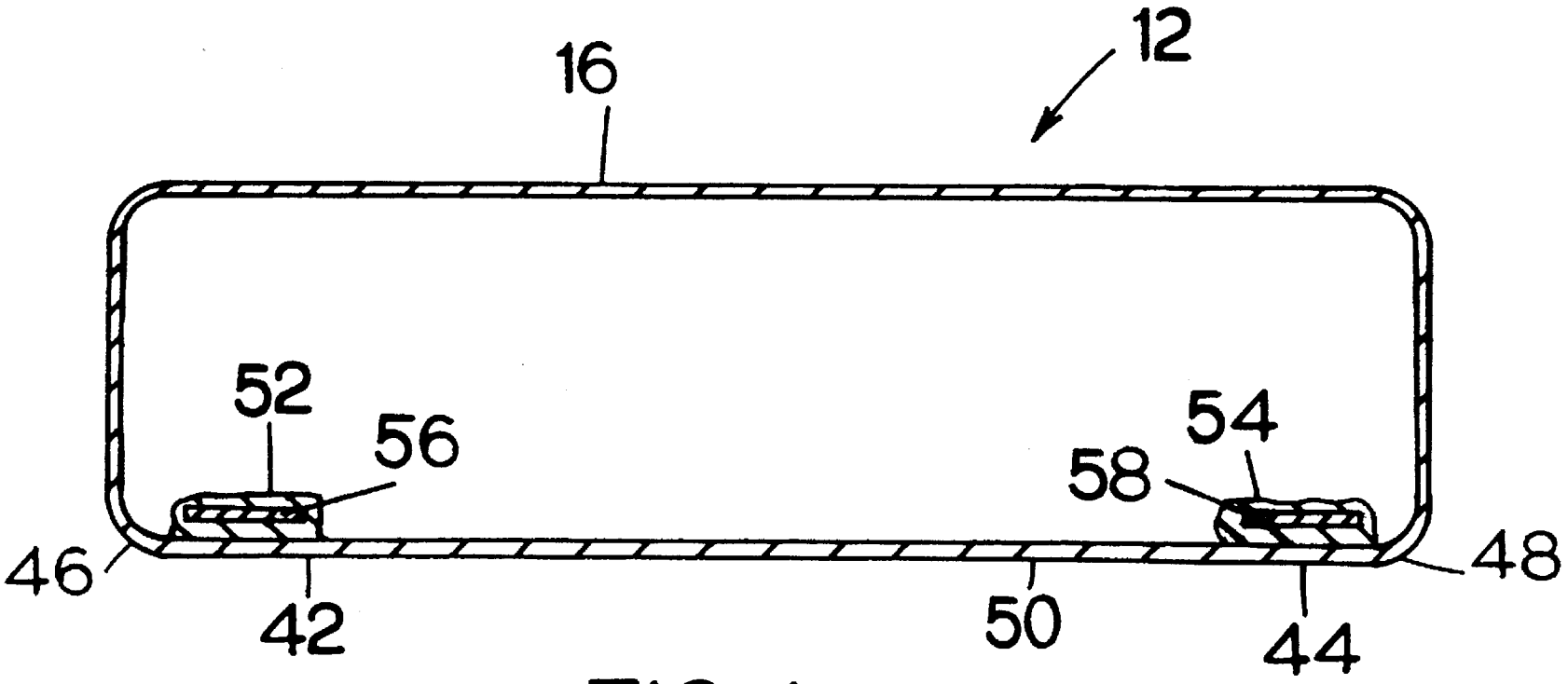
FIG. 4 is a cross sectional view, taken along lines 4—4 from FIG. 3, showing the rigid frame members in the gear pack.
Figure 5:
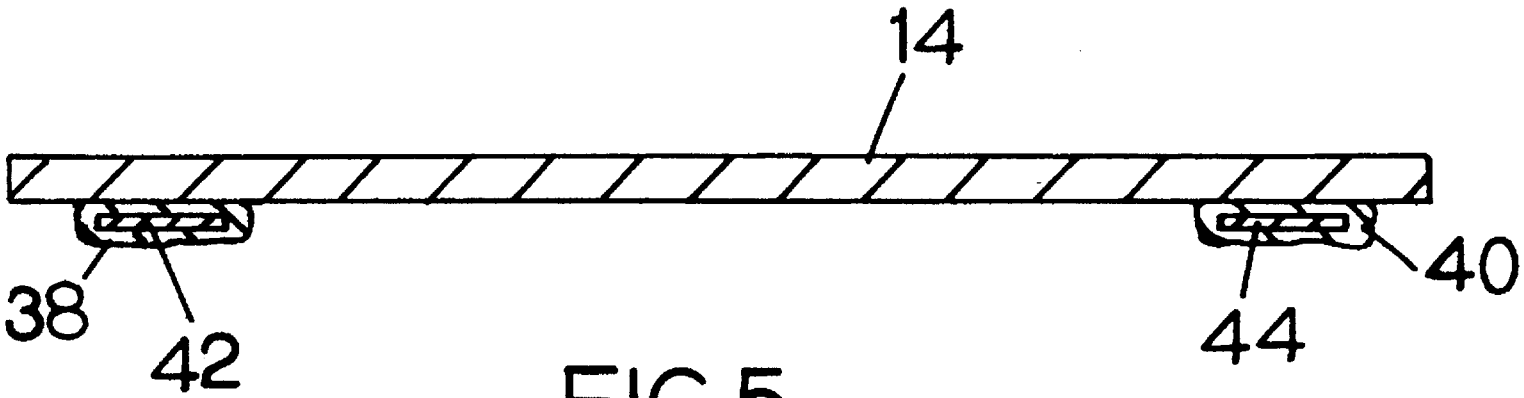
FIG. 5 is a cross sectional view, taken along lines 5—5 from FIG. 3, showing the rigid frame members in the seat member.
Figure 6:
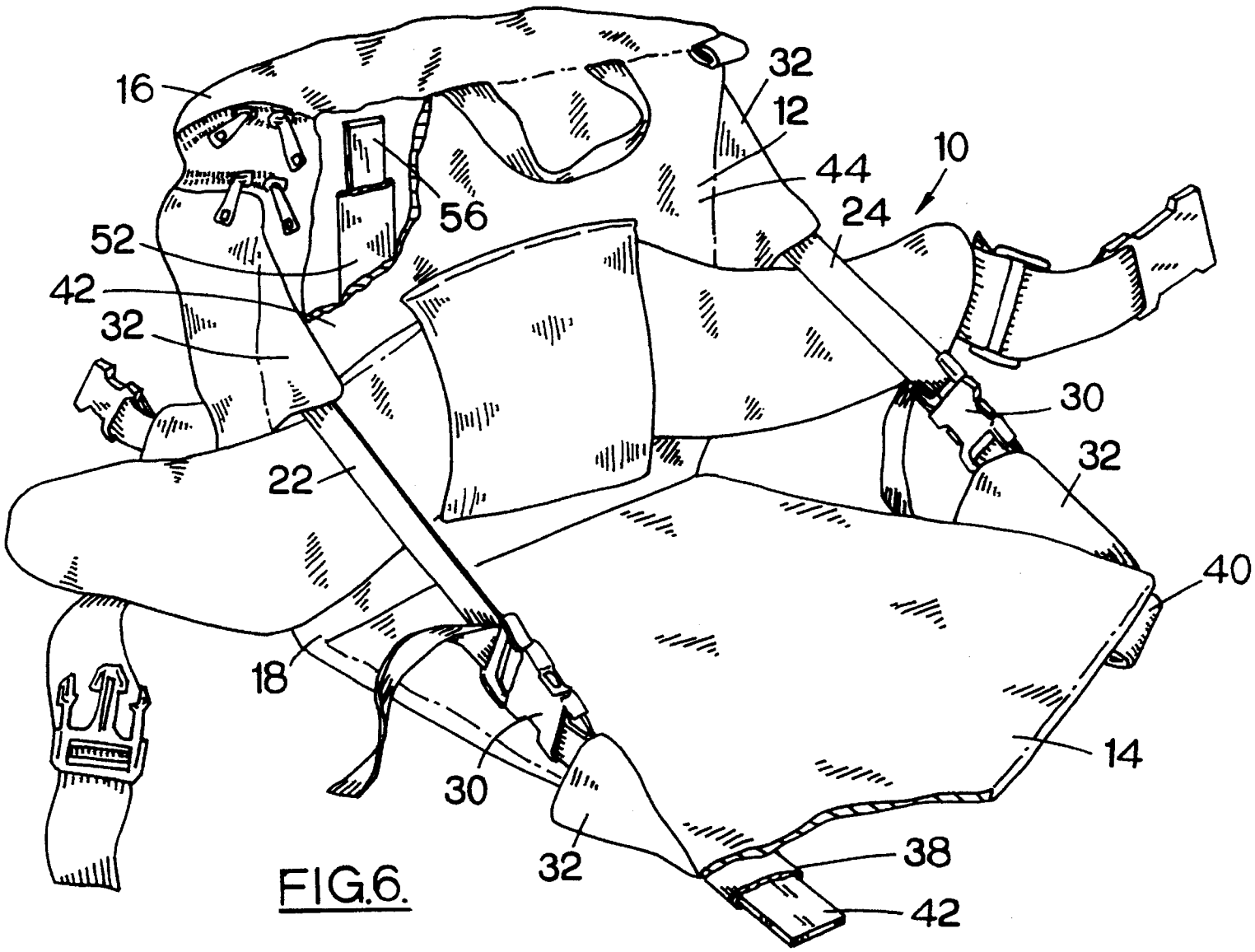
FIG. 6 is a view similar to FIG. 3, with portions of the seat member and the gear pack broken away to show the rigid frame members.

For structural support, the outer lateral marginal edges 34 and 36 of seat member 14 can be made to be rigid. One suitable embodiment features providing seat member 14 with longitudinal pockets 38 and 40 which receive elongated rigid members 42 and 44 as seen in FIGS. 5 and 6. These pockets can be located either externally or internally of seat member 14. Likewise, the lateral outer marginal edges 46 and 48 of the inside face 50 of bag member 16 of gear pack 12 can also be made to be rigid. A suitable embodiment similarly features providing bag member 16 with longitudinal pockets 52 and 54 which receive elongated rigid members 56 and 58 as seen in FIGS. 4 and 6.

USE

The inventive combination gear pack and pivotable seat member is easily employed by a user to convert the pack into an effective stand-alone seat. While in its primary function by a user 11 as a gear pack, the pivotable seat member 14 is used as a compressive load support as shown in FIG. 1 and helps to retain stored articles, such as poncho 60, externally of gear pack 12. Straps 22 and 24 draw seat member 14 tightly against gear pack 12.

Figure 3:
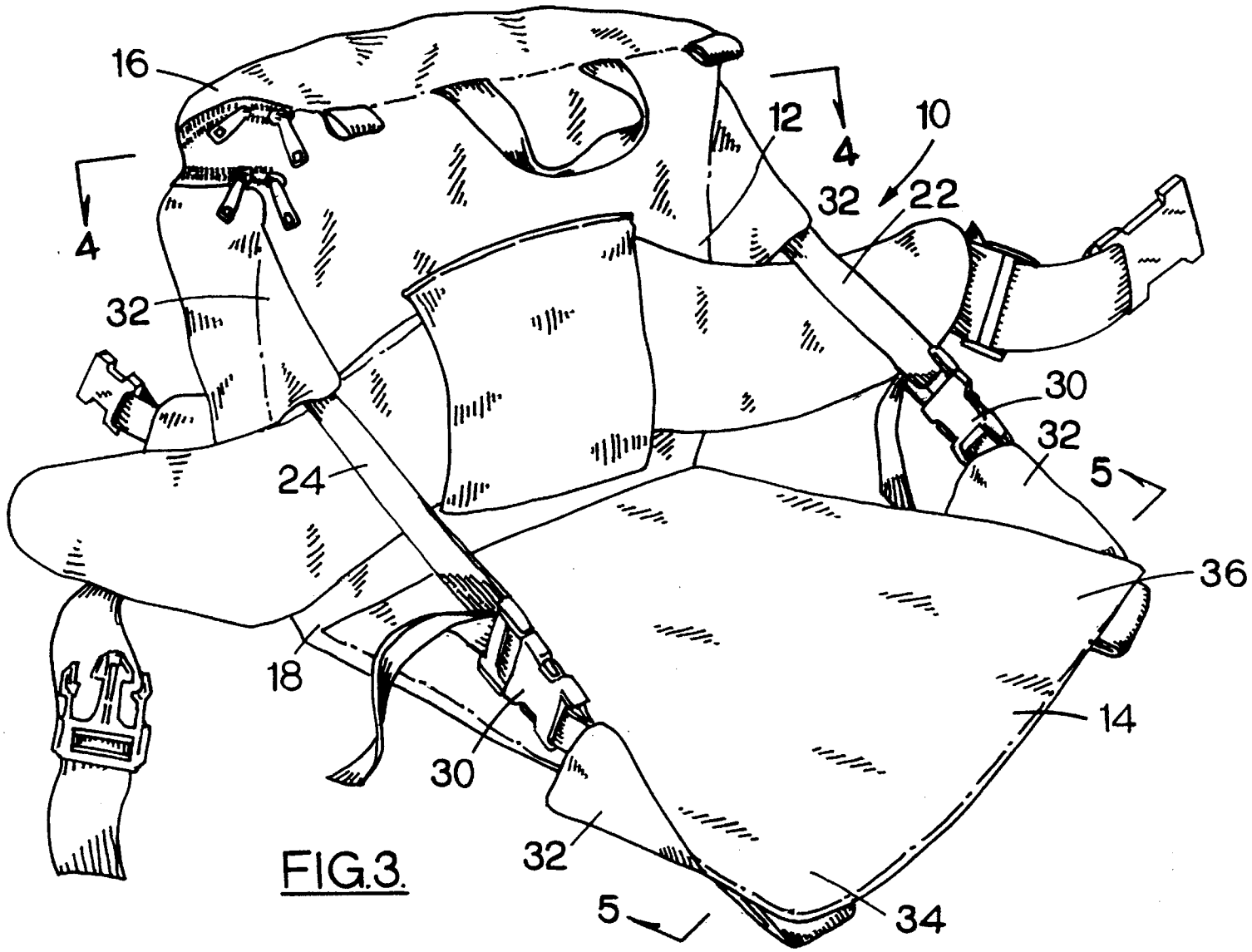
FIG. 3 is a perspective view of the seat member supported from the pack to form an effective seat.

The pack can be easily converted from a load carrier into an effective seat as shown in FIG. 3 by merely releasing straps 22 and 24, pivoting seat member 16 to a position in front of gear pack 12, then refastening straps 22 and 24. Buckles 30 enable the connective length of the straps to be adjusted so that the angular distance between gear pack 12 and seat member 14 can be varied for suitable user comfort. The erected seat can then be placed on any seating surface, whether it be standing alone on the ground, placed on a flat bleacher seat, or even nestled into an existing seat or chair.

User comfort is enhanced by virtue of the rigid members placed in the marginal edges of both the seat member and the gear pack. Padding can also be added throughout the seat member and gear pack. The erected seat can be placed directly on the ground, on a flat surface such as a bleacher, or in an existing seat structure. The back angle is easily adjusted as desired by the user by manipulation of the straps.

Various changes and modifications may be made within this invention as will be apparent to those skilled in the art. Such changes and modifications are within the scope and teaching of this invention as defined in the claims appended hereto.

What is claimed is:

1. A combination gear pack and seat member, said gear pack comprising a fabric bag member with means for being supported from a user's body, a front face of said bag member having a broad surface area for support against a user's body and a rear face of said bag member adapted to face away from the user's body when said front face is positioned against the user's body, said seat member comprising a fabric member, an edge of said seat member being connected to said bag member along a bottom edge of said bag member, said seat member being pivotable about an axis of said connection over a range between a position adjacent said front face of said bag member to a position adjacent said rear face of said bag member, means being provided for supporting said seat member from said bag member whereby a seating surface for said user is formed, said means for supporting said seat member from said bag member comprise straps connecting said seat member to said bag member.

2. The combination gear pack and seat member of claim 1 in which said straps connecting said seat member to said bag member comprise two pairs of connecting straps, a first of said pairs being attached to said bag member, and a second of said pairs being attached to said seat member, said first of said pairs being connectable to said second of said pairs by quick connect/disconnect buckles.

3. The combination gear pack and seat member of claim 1 in which respective lengths of said straps are adjustable, whereby an angular orientation between said seat member and said bag member is adjustable.

4. The combination gear pack and seat member of claim 1 in which outer longitudinal side margins of said seat member are rigid.

5. The combination gear pack and seat member of claim 1 in which outer longitudinal side margins of said front face of said bag member are rigid.

6. The combination gear pack and seat member of claim 1 in which outer longitudinal side margins of said seat member and outer longitudinal side margins of said front face of said bag member are rigid.

7. The combination gear pack and seat member of claim 6 in which said front face of said bag member and said seat member are padded.

8. The combination gear pack and seat member of claim 1 in which said seat member and said front face of said bag member each have pockets along longitudinal side margins for removably receiving rigid members.

9. The combination gear pack and seat member of claim 1 in which outer longitudinal side margins of said seat member and outer longitudinal side margins of said front face of said bag member are rigid and said straps being adjustable, whereby the angular orientation between said seat member and said bag member is adjustable.

10. In a gear pack comprising a flexible fabric bag having means for being supported on a user's body, with a front face of said bag member having a broad surface area for support against a user's body and a rear face of said bag member adapted to face away from the user's body when said front face is positioned against the user's body, the improvement comprising a seat member connected to said bag member along a bottom edge of said bag member, said seat member being pivotable about an axis of said connection over a range between a position adjacent said front face of said bag member to a position adjacent said rear face of said bag member, means being provided for supporting said seat member from said bag member whereby a seating surface for said user is formed, said means for supporting said seat member from said bag member comprise straps connecting said seat member to said bag member.

11. The gear pack of claim 10 in which said straps connecting said seat member to said bag member comprise two pairs of connecting straps, a first of said pairs being attached to said bag member, and a second of said pairs being attached to said seat member, said first of said pairs being connectable to said second of said set pairs by quick connect/disconnect buckles.

12. The gear pack of claim 10 in which respective lengths of said straps are adjustable, whereby an angular orientation between said seat member and said bag member is adjustable.

13. The gear pack of claim 10 in which outer longitudinal side margins of said seat member are rigid.

14. The gear pack of claim 10 in which outer longitudinal side margins of said front face of said bag member are rigid.

15. The gear pack of claim 10 in which outer longitudinal side margins of said seat member and outer longitudinal side margins of said front face of said bag member are rigid.

16. The gear pack of claim 15 in which said front face of said bag member and said seat member are padded.

17. The gear pack of claim 10 in which said seat member and said front face of said bag member each have pockets along longitudinal side margins for removably receiving rigid members.

18. The gear pack of claim 10 in which outer longitudinal side margins of said seat member and outer longitudinal side margins of said front face of said bag member are rigid and respective lengths of said straps being adjustable, whereby the angular orientation between said seat member and said bag member is adjustable.

19. The gear pack of claim 10 in which said seat member is pivotable to said position to said rear of said bag member where said seat member is capable of being held in engagement against said bag member and whereby a load can be held and secured between said bag member and said seat member.

20. The combination gear pack and seat member of claim 1 in which said seat member is pivotable to said position to said rear of said bag member where said seat member is capable of being held in engagement against said bag member and whereby a load can be held and secured between said bag member and said seat member.

* * * * *